US011285373B2

(12) United States Patent
Peterson et al.

(10) Patent No.: US 11,285,373 B2
(45) Date of Patent: Mar. 29, 2022

(54) OPEN FIELD GAME ARRANGEMENT INCLUDING GLOWING AND RESPONSIVE TARGETS

(71) Applicant: OFF COURSE PRODUCTIONS, INC., Palm Springs, CA (US)

(72) Inventors: Robert Glen Peterson, Palm Springs, CA (US); Stephen W Brewer, New Albany, IN (US)

(73) Assignee: OFF COURSE PRODUCTIONS, INC., Palm Springs, CA (US)

( * ) Notice: Subject to any disclaimer, the term of this patent is extended or adjusted under 35 U.S.C. 154(b) by 31 days.

(21) Appl. No.: 16/882,787

(22) Filed: May 26, 2020

(65) Prior Publication Data

US 2020/0384341 A1 Dec. 10, 2020

Related U.S. Application Data

(63) Continuation-in-part of application No. 16/260,609, filed on Jan. 29, 2019, now Pat. No. 10,695,635.

(51) Int. Cl.

| | |
|---|---|
| ***A63F 9/00*** | (2006.01) |
| ***A63B 71/06*** | (2006.01) |
| ***A63B 63/00*** | (2006.01) |
| ***A63B 67/00*** | (2006.01) |
| ***A63B 71/02*** | (2006.01) |
| ***A63B 67/02*** | (2006.01) |

(52) U.S. Cl.

CPC ..... *A63B 71/0605* (2013.01); *A63B 63/00* (2013.01); *A63B 67/002* (2013.01); *A63B 67/02* (2013.01); *A63B 71/02* (2013.01); *A63B 2063/001* (2013.01); *A63B 2220/89* (2013.01); *A63B 2225/74* (2020.08)

(58) Field of Classification Search

CPC ..... A63F 9/0204; A63F 9/0243; A63B 63/00; A63B 2063/002; A63B 63/004; A63B 69/36

See application file for complete search history.

(56) References Cited

U.S. PATENT DOCUMENTS

| | | | |
|---|---|---|---|
| 2,695,173 | A | 11/1954 | Sterne |
| 3,369,812 | A | 2/1968 | McKee |
| 3,877,704 | A | 4/1975 | Bayley |
| 3,889,957 | A | 6/1975 | Klabacka |
| 4,006,907 | A | 2/1977 | Heffley, Jr. |
| 4,179,832 | A | 12/1979 | Lemelson |
| 4,336,939 | A | 6/1982 | Krumlauf |
| 4,659,090 | A | 4/1987 | Kustanovich |
| 5,354,052 | A | 10/1994 | Nicholls |
| 5,478,077 | A | 12/1995 | Miyahara |
| 5,980,392 | A | 11/1999 | Cox |
| 6,398,662 | B1 | 6/2002 | Cox |
| 6,462,720 | B1 | 10/2002 | Yamashita et al. |

(Continued)

FOREIGN PATENT DOCUMENTS

WO 2007037705 A1 4/2007

OTHER PUBLICATIONS

WDRB, Cosmic Driving Range, p. 1 (Jun. 2, 2015).

(Continued)

*Primary Examiner* — Omkar A Deodhar

(74) *Attorney, Agent, or Firm* — UltimatEdge IP Law Group, P.C.; Dean G. Stathakis

(57) ABSTRACT

An open field game arrangement includes glowing targets and provides responses, such as lights and sounds, when the targets are hit.

20 Claims, 13 Drawing Sheets

(56) References Cited

U.S. PATENT DOCUMENTS

| | | | |
|---|---|---|---|
| 6,554,284 | B2 | 4/2003 | Chou |
| 6,569,028 | B1 | 5/2003 | Nichols et al. |
| 10,232,241 | B2 | 3/2019 | Peterson et al. |
| 10,695,635 | B2 | 6/2020 | Peterson et al. |
| 2002/0109301 | A1 | 8/2002 | Chou |
| 2004/0204258 | A1 | 10/2004 | Hanoun |
| 2005/0153262 | A1 | 7/2005 | Kendir |
| 2008/0106888 | A1 | 5/2008 | Nalitchaev et al. |
| 2008/0125293 | A1 | 5/2008 | Ng |
| 2009/0291782 | A1 | 11/2009 | Hinn |

OTHER PUBLICATIONS

WIPO, PCT Form ISA210, International Search Report for International Patent Application Serial No. PCT/US2017/012729, pp. 5 (dated May 10, 2017).

WIPO, PCT Form ISA237, Written Opinion for International Patent Application Serial No. PCT/US2017/012729, pp. 8 (dated May 10, 2017).

WIPO, PCT Form IB373, International Preliminary Report on Patentability for International Patent Application Serial No. PCT/US2017/012729, pp. 9 (dated Jul. 17, 2018).

OPEN FIELD GAME ARRANGEMENT INCLUDING GLOWING AND RESPONSIVE TARGETS

This application is a continuation-in-part of U.S. patent application Ser. No. 16/260,609, filed Jan. 29, 2019, which is a divisional of U.S. Pat. No. 10,232,241, filed Jan. 9, 2017, which claims priority from U.S. Provisional Application Ser. No. 62/277,096, filed Jan. 11, 2016.

BACKGROUND

There are many large, open field areas including farms, parks, golf driving ranges, football, baseball, and soccer stadiums, that are underused and generate little or no income much of the time. It would be desirable to provide a way to make these open field areas generate more income.

SUMMARY

The present invention provides an open field game arrangement that enables these large, open fields to generate income when not being used for their primary purpose, or at any time. The open field game arrangement includes large, glowing targets that are responsive to being hit by an object, such as by a golf ball, a baseball, a soccer ball, a football, a paddle, or another object controlled by a player of the game.

This open field game arrangement may take advantage of darkness to provide a special entertainment experience, but it also can be used in the daytime.

The glowing targets are hollow structures made of a transparent or translucent skin, with light shining through, from the interior to the exterior of the skin, causing the skin to glow. There is a sensor arrangement that determines when the targets have been hit. There is at least one controller, which controls one or more responses when the targets have been hit. For example, the response may be one or more different colors of light or one or more flashing lights shining from the interior of the target that has been hit and/or from the interior of other targets or from other locations. The response may include a sound generated at the target or at a different location or at multiple locations.

The open field game arrangement may include a scoring system, which may be manually operated or automatic, creating scores when the glowing targets are hit by the players.

DESCRIPTION

Figure 1:
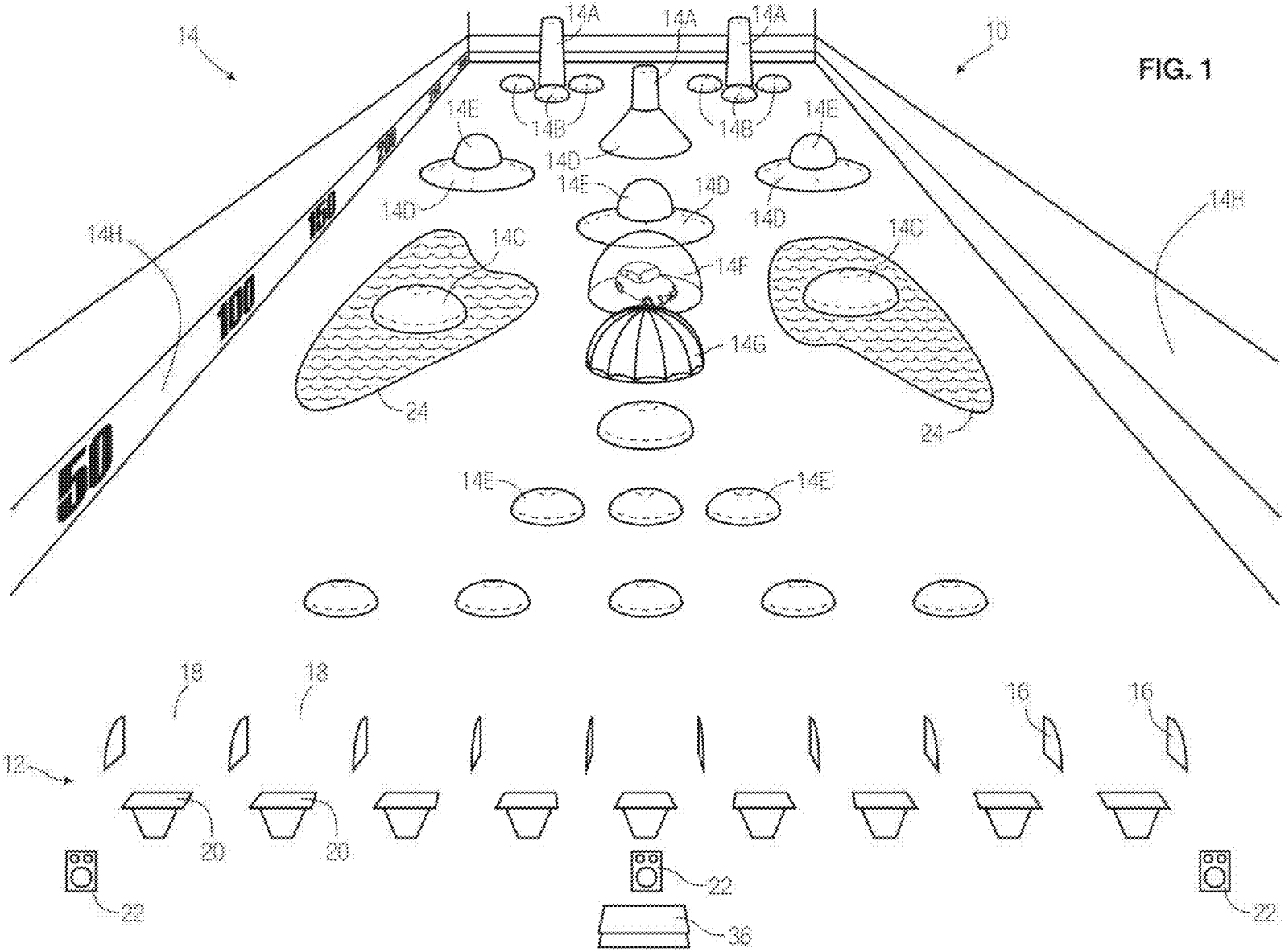
FIG. 1 is a schematic end view of an open field game arrangement employing an embodiment of the present invention.

FIG. 1 shows an embodiment of an open field game arrangement 10 made in accordance with the present invention. The arrangement includes a tee area 12, from which players launch projectiles toward a plurality of targets 14, which are spread out around the field in a desired pattern or arrangement. The tee area 12 includes a plurality of dividers 16, which separate the tee area 12 into lanes 18. Each lane 18 includes a scoring kiosk 20, where the players in the respective lane 18 keep score. The arrangement 10 includes speakers 22 located in the tee area 12 so the players in the tee area 12 can hear the sounds from the speakers 22. There may be additional speakers in other parts of the field, if desired.

Figure 7:
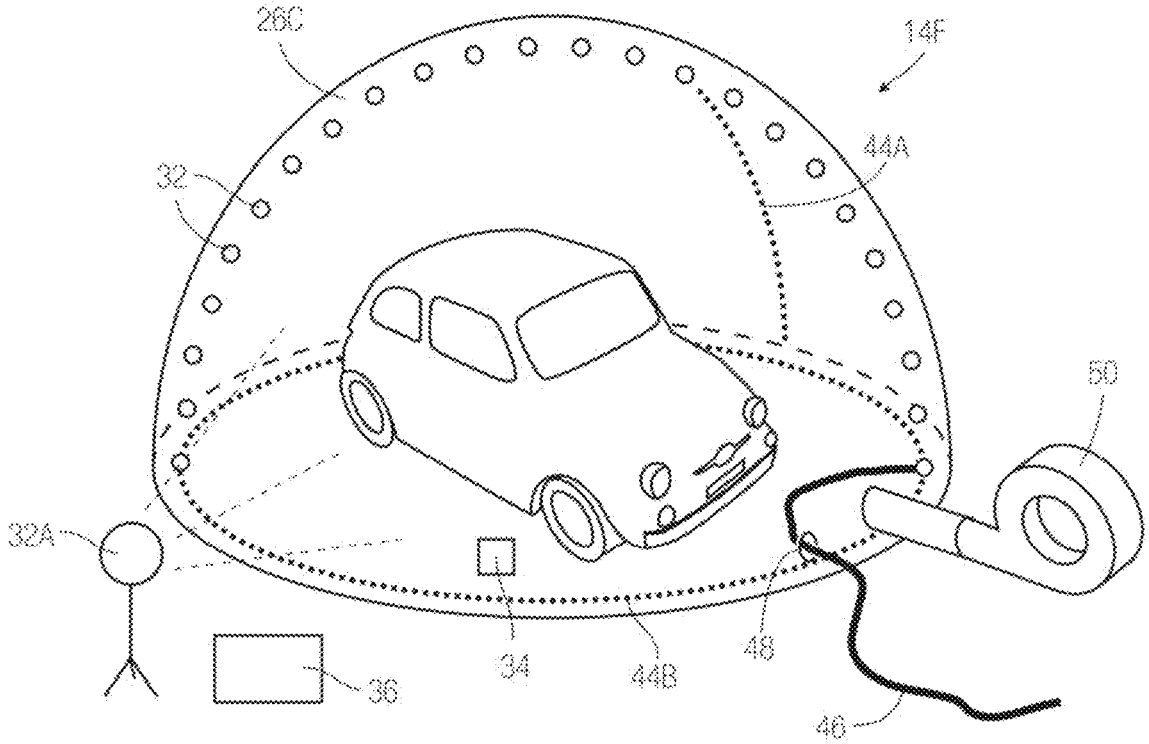
FIG. 7 is a schematic view of another target.

FIG. 1 shows a variety of types of targets 14. Farthest away from the tee area 12 are two inflated pylon targets 14A, which are in the range of seven to fifteen feet tall in this particular embodiment. Each of these inflated pylon targets 14A is surrounded by a plurality of much shorter inflated mushroom or dome-shaped targets 14B. The open field includes two small ponds 24 filled with water, with a floating, waterproof, inflated mushroom target 14C anchored in each pond 24. In front of the two rear pylon targets 14A is an inflated pylon target 14A with a skirt 14D. In front of those are some land-based, inflated mushroom targets 14E with skirts 14D. There also is a transparent inflated mushroom 14F, which houses a car (or other object), as shown in FIG. 7. There also is a pop-up mushroom target 14G, shown in more detail in FIG. 8, and various other mushroom targets 14E in the front portion of the field. On the sides of the field are translucent banners 14H, which may also serve as targets and which include markings indicating the distance from the tee (i.e. 50 yards 100 yards, 200 yards, and so forth). It is understood that this is just one example of an arrangement of targets and that a variety of arrangements may be used.

Each of the targets 14A-H is made of a thin skin that allows light in the visible range to pass through the skin. The skin may be translucent or transparent. The skins are large, having at least one dimension that is at least three feet (i.e. 3 feet tall or 3 feet wide, etc.). While the skin may be made of a rigid material, it is preferred that the skin be made of a foldable material so it can be collapsed for storage and transport. A foldable material does not have sufficient structure of its own to hold its shape, so it uses some way to keep its shape, such as by being inflated or by being supported by a more rigid framework of some type, such as rods made of fiberglass, metal, or other desired material or inflated tubes, for example. There is at least one light associated with each target that shines outwardly through the thin skin, the light shining onto the inner surface of the thin skin and through the thin skin and out the outer surface of the thin skin, which gives the thin skin a glowing appearance. There may be several lights of various colors that can shine outwardly through the thin skin and that can be selectively controlled to turn on and off individually as desired. There also may be lights shining onto the thin skins from outside the skins, as will be described in more detail later.

Figure 2:
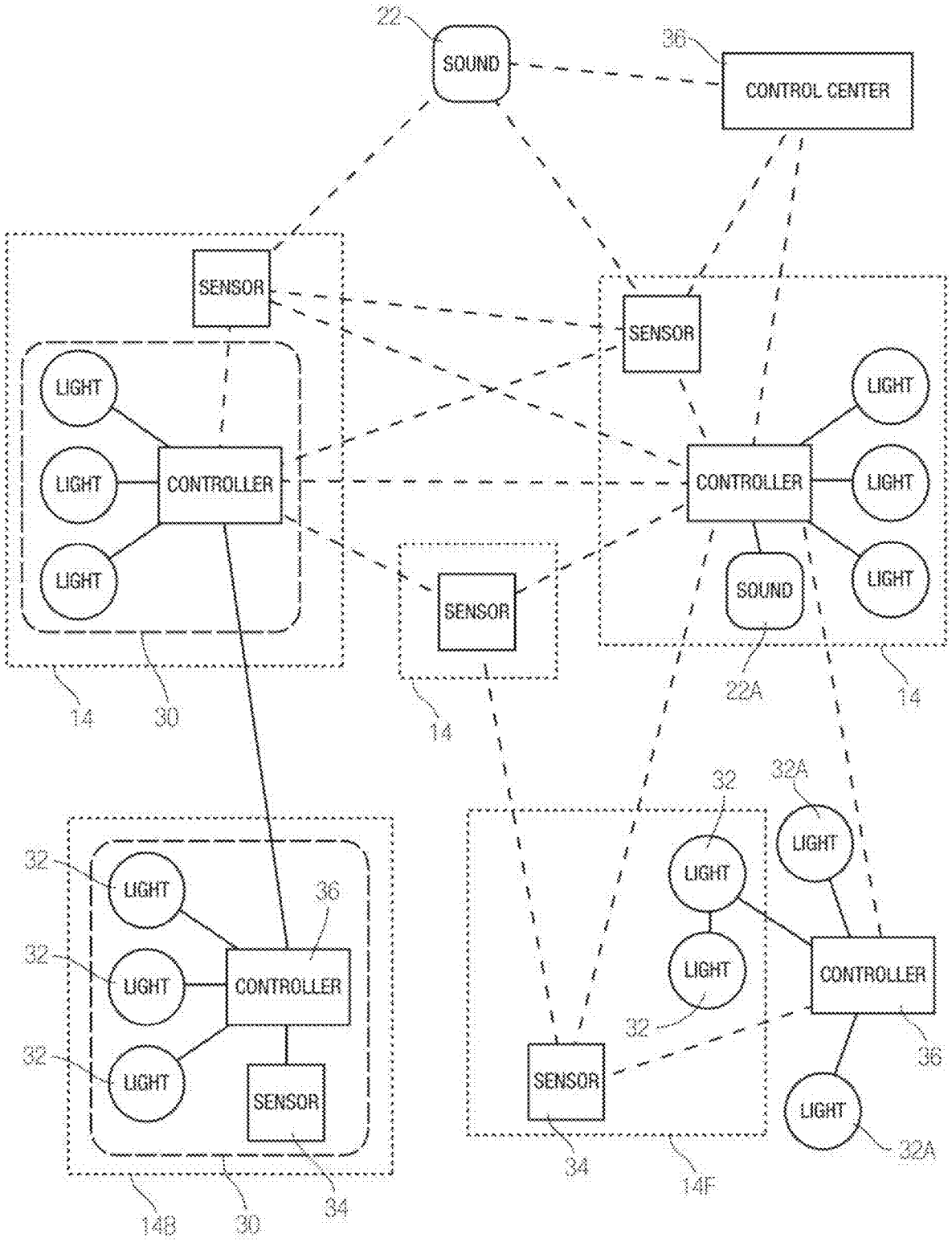
FIG. 2 is a schematic diagram of the control logic of a portion of the open field game arrangement of FIG. 1.

FIG. 2 is a schematic of a portion of the control arrangement for the open field game arrangement 10. The control arrangement includes an arrangement for sensing when the targets have been hit and generating responses, including turning on lights and generating sounds that can be heard in the tee area when the targets are hit. The sensing arrangement may use a sensor 34 adjacent to each target to sense when that target is hit. The sensors may be in the form of a piezoelectric device or other transducer adapted to generate an electrical or optical or other usable signal in response to a sensed mechanical vibration or event, e.g., sound or physical impact. In addition, or alternatively, it may use a tracking system at a control center 36 that tracks the projectiles to sense when the targets are hit. There are various known tracking systems that may be used. These tracking systems utilize cameras, GPS (Global positioning systems), Doppler, or 3D Doppler radar to track the projectiles. These tracking systems include a stored map of the target arrangement and correlate the position of the projectile with the stored map to determine when the targets are hit, generate a signal indicating that a target is hit, and communicate that signal with the control system to indicate when the targets are hit. When the control system receives a signal indicating that a target has been hit, the control system then communicates with lights, sound generators, and display screens and generates a response, which may include turning lights on and off at the target that has been hit, at other targets, and elsewhere on the field, generating sounds, including generating a different sound for each different type of target, and generating a score display on a fixed screen or on a portable device running an app, such as a smart phone. Examples of some known tracking systems that could be used include TopTracer by TopGolf, Flightscope® of Orlando, Fla., Trackman of Scottsdale, Ariz., Inrange of London, and Flite of Tulsa, Okla.

Figure 3A:
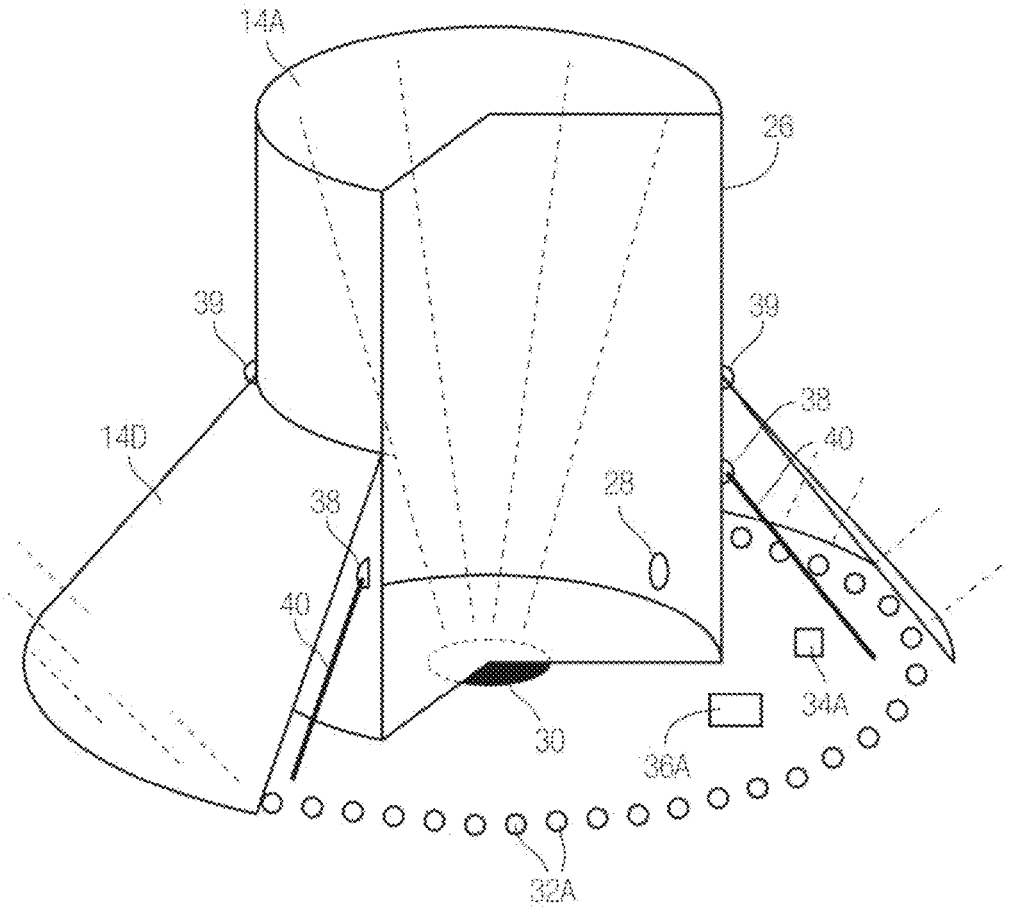
FIG. 3A is a schematic view of one of the targets of FIG. 1 shown in section.
Figure 3B:
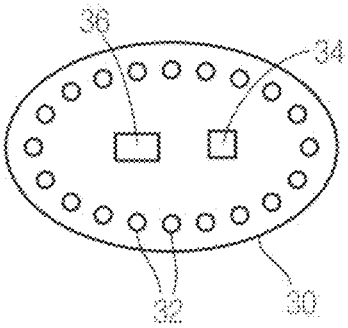
FIG. 3B is a schematic view of a control panel used in the target of FIG. 3A.
Figure 3C:
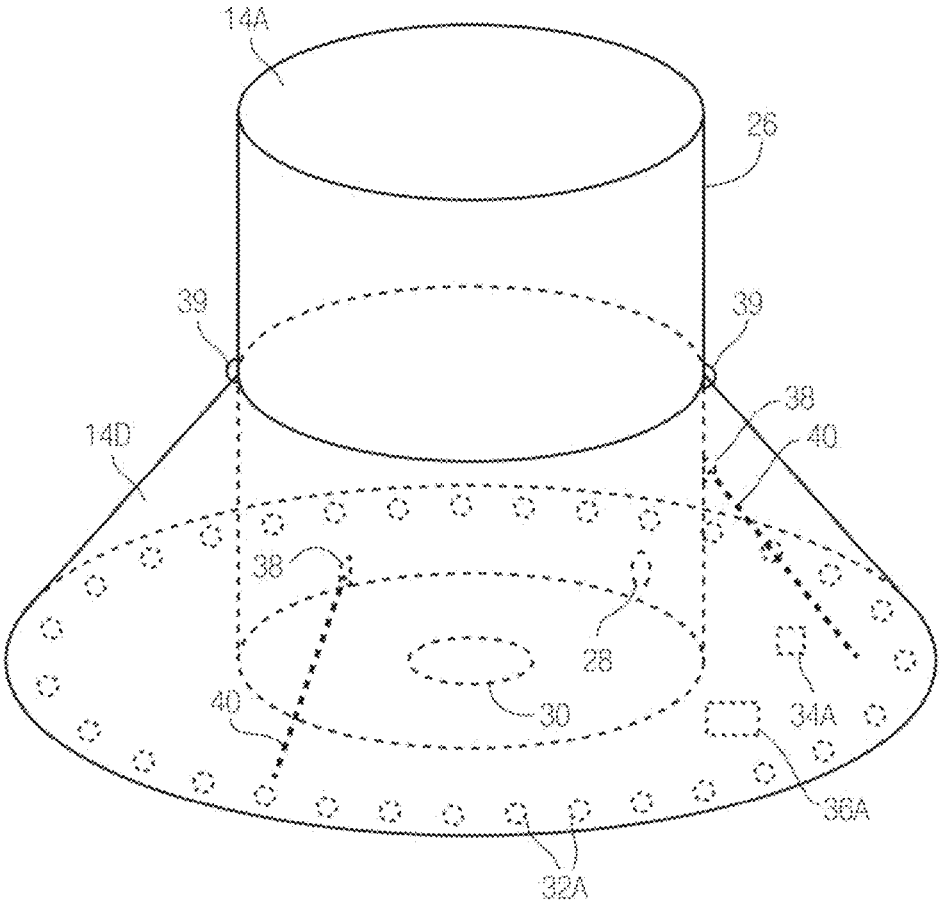
FIG. 3C is a schematic view of the target of FIG. 3A.

FIGS. 3A and 3C are schematics of the pylon 14A with skirt 14D shown in FIG. 1. The pylon 14A has a cylindrically-shaped skin 26, including a flat top and bottom. The skin 26 is made of a foldable material that collapses and can be folded up for storage and transport but that keeps its shape when it is inflated. The skin 26 is sealed against the escape of air and has an inflation opening 28 with a sealable closure that is sealed shut when the skin 26 is not being inflated (similar to the inflation opening in an air mattress). The skin 26 defines a hollow interior. The bottom of the skin 26 is transparent or includes a transparent window portion, which rests on top of a panel 30 that rests on the ground and that houses a plurality of lights 32, a sensor 34, and a controller 36. The panel 30 is shown in more detail in FIG. 3B. The lights 32 are directed upwardly to shine through the transparent portion at the bottom of the skin 26, onto the inner surface of the skin 26, through the skin 26, and out the outer surface of the skin 26, as indicated by the broken lines radiating from the panel 30 in FIG. 3A.

The sensor 34 senses when the skin 26 has been hit. In this particular embodiment, the sensor 34 includes a local transducer, e.g., a microphone that senses the sound that is made when a projectile hits the skin 26, and generates a representative electrical signal in response to the sensed mechanical force associated with the hit/sound. The controller 36 communicates with the lights 32 and with the sensor 34 and controls the lights 32 in response to a signal received from the sensor 34. The system of game components, i.e., sensors, controllers, lights, and other control components, typically require a power source and communicate over a communication network. For example, the communication network may be wired or wireless or a combination thereof and may be a LAN, WLAN, Ethernet, token ring, CAN bus, FDDI ring or other communications network infrastructure. The controller 36 also may communicate with other controllers and sensors in the system, in a wired or wireless configuration or combination thereof, as will be described later. Alternatively, the sensor may be implemented as a feature of a tracking system and the controller may be a central controller associated with a centralized tracking system. Also, signals may be analog, digital or a combination of both and may be modulated in some form for transmission. Signals may be electrical or optical and transmission may be in the form of a hybrid electro-optic transmission. Controllers may employ one or more integrated circuits (IC), e.g., ASIC (Application-Specific IC, FPGA (Field Programmable Array), with memory capability and may include analog-to-digital converters and other components.

There are ears 38 secured to the skin 26, through which tie down cables 40 pass to secure the pylon target 14A to the ground. The tie down cables 40 may be secured to the ground using stakes or other known anchors (not shown).

A tapered skirt 14D surrounds the pylon target 14A. The skirt 14D has an upper edge that is secured to the pylon target 14A at a height above the ground and a lower edge that is secured to the ground at a diameter that is much larger than the diameter of the pylon target 14A. The upper edge of the skirt 14D may be secured to the pylon target 14A in a variety of ways. The upper edge of the skirt 14D may be welded or sewn to the pylon target 14A in a manner that retains the air-tight nature of the skin 26 of the pylon target 14A. Alternatively, the upper edge of the skirt 14D may define a casing that receives a stiffening ring, and the casing or the stiffening ring may be secured to the pylon target 14A by a plurality of D-rings spaced around the perimeter of the pylon target 14A at a desired height above the ground. The stiffening ring (not shown) may be made of fiberglass rods with ends that nest like a fishing rod, or it may be made of PVC pipe with fittings, or metal pipe or tubing, or other desired materials.

The skirt 14D has a lower edge that rests on the ground, and the lower edge is secured to the ground in some known manner, such as by using a ballast such as sand bags or water bags or using D-rings spaced around the lower edge that are secured to the ground by tent stakes or other anchors. There may also be a stiffening ring in a casing at the bottom edge of the skirt 14D, if desired. The skirt 14D is made of a skin of a similar foldable material that is open at the bottom and that defines a hollow interior. Several lights 32A rest on the ground underneath the skirt 14D and are directed to shine upwardly onto the inner surface and through the skin of the skirt 14D. A sensor 34A is associated with the skirt 14D and senses when the skirt 14D is hit. A controller 36A is associated with the skirt 14D. The controller 36A communicates with the lights 32A, with the sensor 34A, and with the controller 36, as well as with other controllers in the system.

Figure 4A:
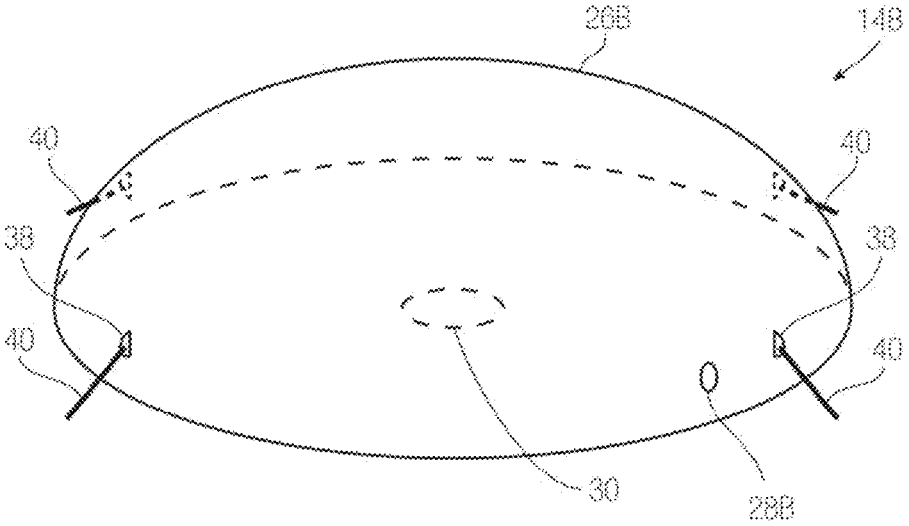
FIG. 4A is a schematic perspective view of the target of FIG. 4.
Figure 4:
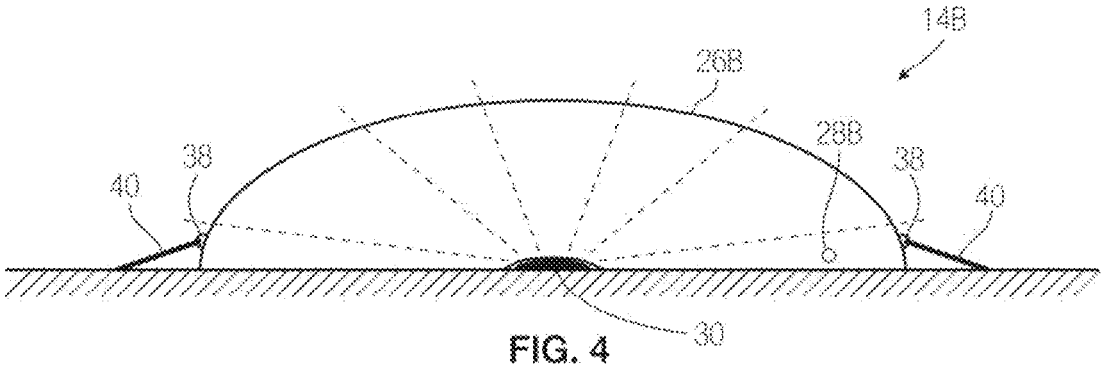
FIG. 4 is a front schematic view of another target.

FIGS. 4 and 4A show an inflated mushroom or dome-shaped target 14B, which includes a skin 26B defining a sealed, hollow interior. The skin 26B is inflated by air. The skin 26B is made of a foldable cloth, plastic or other material that does not hold its own shape, so, in this case, it uses air pressure to keep it in a desired shape. This target 14B is sealed, so it does not require a constant air supply to remain inflated, but it may have to be re-inflated every few days to make sure the skin 26B remains taut. As with the pylon target 14A described earlier, air for inflation is added in the same manner as for an inflatable mattress, using an air pump or pressurized air canister to inject air through a port 28B through the skin 26B, and then closing the port 28B. As with the target 14A, this mushroom target 14B has a clear window on its bottom surface. The target 14B rests on the ground with a control panel 30 underneath the target 14B. As described earlier with respect to the pylon target, the control panel 30 has lights 32 directed upwardly to shine through the window, through the interior of the target 14B, onto the inner surface of the skin 26B, and then through the skin 26B.

In this embodiment, the majority of the skin 26B is translucent. The skin 26B (and skins for other targets) may be made from several commonly available materials. In this embodiment, the skin 26B is foldable and may be made from relatively thick (10 ounce-33 ounce or 6 mm-30 mm-thickness) RhinoSkin™ (RhinoSkin™ is a trademark of InterWrap® of Vancouver, Canada), a high strength geomembrane specifically engineered for heavy-duty liners and covers and which is easy to weld in the factory and in the field. Other suitable foldable materials for the skin 26B and other skins for other targets may be reinforced polyester, or a Tyvek® material (Tyvek® is a registered trademark of Dupont™), polyurethane coated ripstop nylon or polyester, or other materials.

In this embodiment, the lights 32 are LED lights, but other types of lights could be used.

This particular panel 30 is powered by a 48 volt DC power source. As with the previous embodiment, the panel 30 includes lights, 32, a sensor 34, and a controller 36. The sensor 34 senses when the skin 26B has been hit. The sensor 34 may include one or more microphones that sense the sound waves created by the vibration of the skin 26B when the skin 20 is hit. The sensor 34 alternatively, or in addition, may include one or more piezo-electric sensors connected to the skin 26B to detect vibration of the skin 26B when the skin 26B is hit. Other types of sensors adjacent to the skin 26B may be used. As described earlier, in addition to or instead of the sensor 34 adjacent to the skin 26B, a tracking arrangement may be used to track the path of a projectile directed toward the targets in order to determine when the target is hit.

This inflated mushroom target 14B is anchored by means of tie-down cables 40 secured to ears 38.

Figure 5:
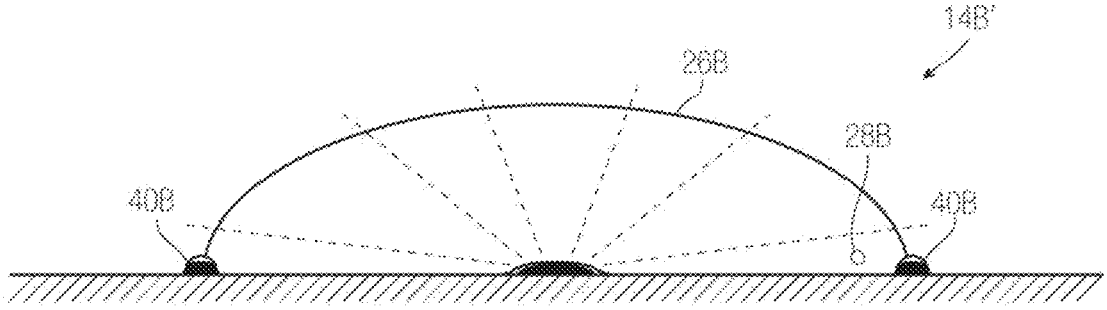
FIG. 5 is a schematic front view of another target.

FIG. 5 shows an inflated mushroom target 14B', which is similar to the previous target 14B except that it is anchored by sandbags (water bags, or other ballast) 40B around the perimeter.

Figure 6:
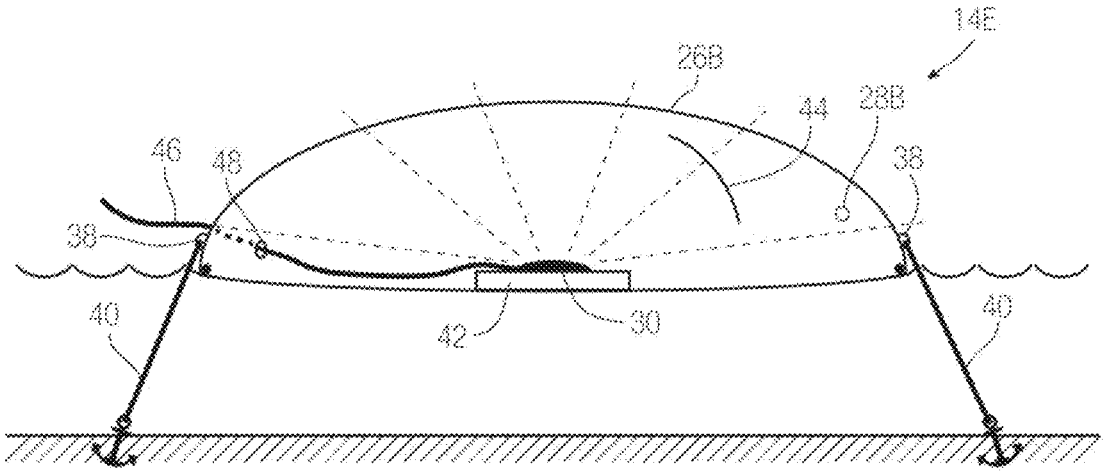
FIG. 6 is a schematic front view of another target.
Figure 9A:
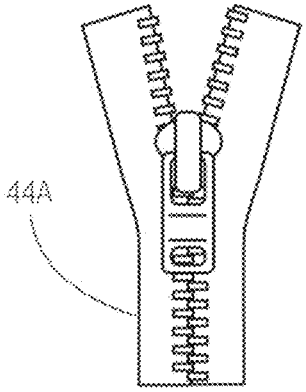
FIG. 9A is a schematic view of a zipper that is used on the target of FIG. 7.
Figure 9B:
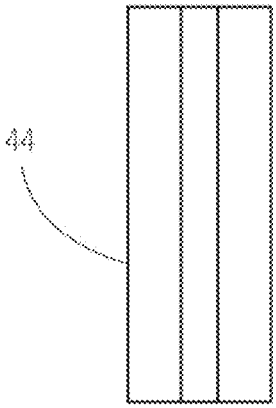
FIG. 9B is a schematic view of a zip lock that is used on the target of FIG. 6.

FIG. 6 shows a waterproof, inflated mushroom target 14E, which floats on water and is anchored in placed by anchors secured to tie-down cables 40 secured to ears 38. This embodiment is inflated by injecting pressurized air through an injection port 28B which closes after the target is inflated. In this embodiment, the panel 30 that houses the lights 32, sensor 34 and controller 36 rests on top of a Styrofoam board 42, which rests on top of the floor of the skin 26B, which floats on top of the water. In order to insert the panel 30 into the interior of the sealed skin 26B, there is a zip lock opening 44 that is zipped open to insert the panel and board 42 and to connect the panel 30 to the power cable 46 and then is zipped closed to restore the sealed condition of the target 14E. This zip lock arrangement is shown in FIG. 9B and is similar to the zip lock on a sandwich bag, which creates an air tight and water tight seal. There also is a small power cable opening 48, through which the power cable 46 passes to enter into the interior of the target 14E. That opening 48 has a gasket around its perimeter which seals against the power cable 46 to maintain the air-tight, water-tight, sealed condition of the target 14E. Like the other panels 30, this panel 30 includes lights 32, a sensor 34, which senses when the skin 26B is hit, and a controller 36 that communicates with the lights 32, the sensor 34, and with other controllers in the system.

It should be noted that the power cables that power the panels 30 in the previous embodiments of FIGS. 3, 4 and 5 are not shown, but it is understood that they simply pass underneath the respective targets 14A, 14B, 14B' to connect to the respective panels 30. It also may be possible to use battery power for the various components, which may eliminate the need for a power cable.

FIG. 7 shows a transparent, inflated mushroom target 14F, which is made of a foldable, transparent skin 26C that is inflated by means of a continuous blower 50. The lights 32 inside this transparent skin 26C are arrayed all around the skin 26C and are powered by a power cable 46 which enters through a power cable opening 48 with a gasket seal as described earlier. There also are lights 32A that are located outside of the target 14F and shine onto the outer surface of the skin 26C and onto the car or other product. There is a sensor 34 inside this target 14F, which senses when the target 14F is hit and which communicates wirelessly with a controller 36 outside the target 14F, which communicates wirelessly with the lights 32 inside the target 14F. The car or other object inside the target 14F is protected by the skin 26C, which is kept inflated by the pressurized air being continually introduced by the blower.

The embodiment of FIG. 7 has zipper openings 44A, 44B, which are zipped open to insert the car (or other product), the lights 32 and the sensor 34, and which then are zipped closed. This is a regular toothed zipper similar to the types of zippers used on clothing (see FIG. 9A). This zipper closure 44A leaks a little bit of air, but that is not a problem, since the continuous blower 50 provides enough new air input to make up for the losses. (In other situations, a sealed zip lock closure may be used if a continuous seal is desired, as described earlier.)

Figure 8:
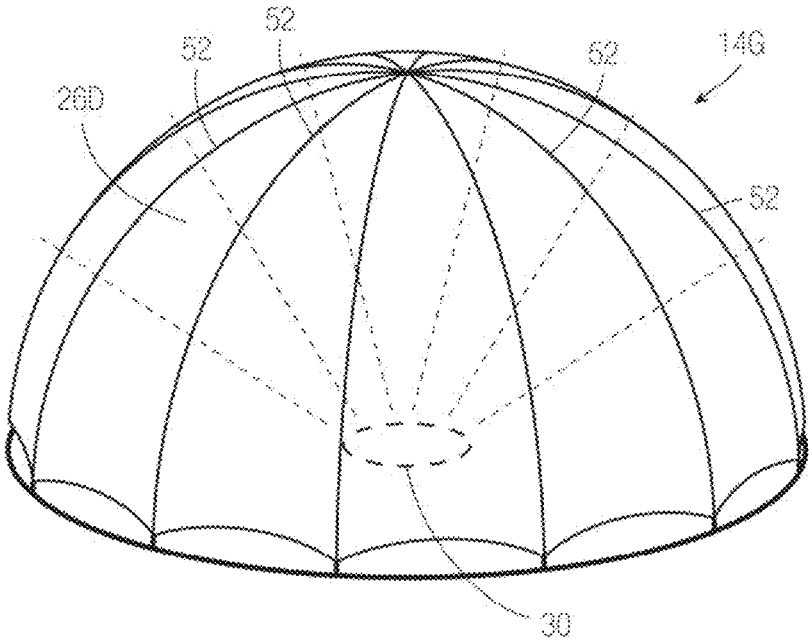
FIG. 8 is a schematic view of another target.

FIG. 8 shows a pop-up type of target 14G, similar to a pop-up tent, which has a foldable skin 26D and uses flexible ribs 52 to support the skin 26D. The bottom of the target 14G is open, and the panel 30 rests on the ground on the interior of the target 14G. The ribs 52 may be flexible rods made of fiberglass, metal or other flexible material, or they may be inflated tubes. In any case, the ribs 52 form a support structure to support the skin 26D.

Figure 10:
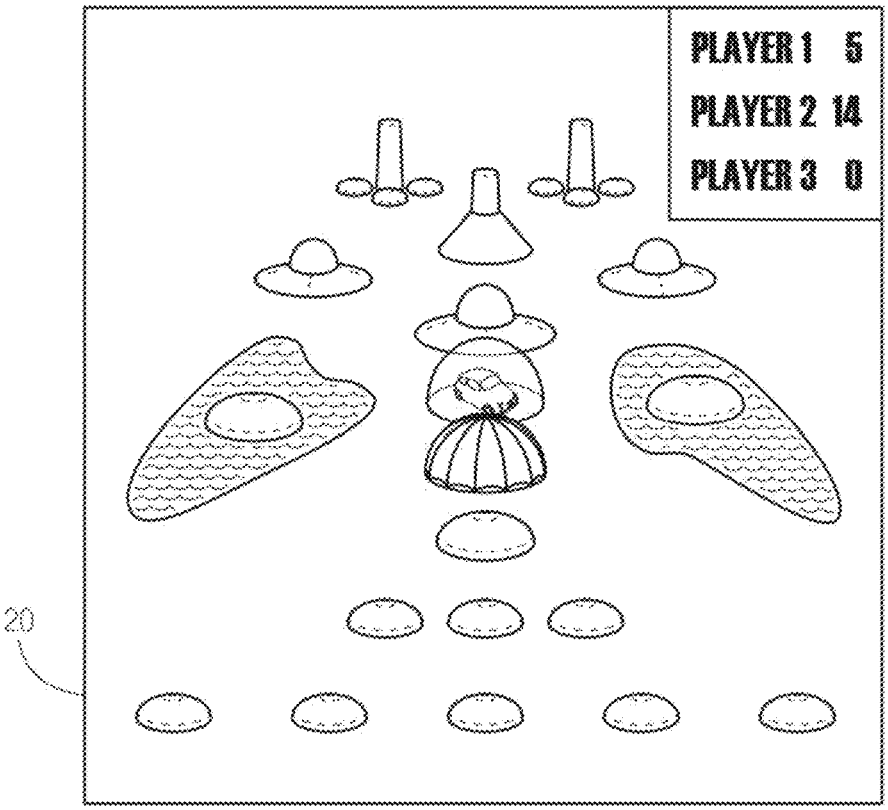
FIG. 10 is a plan view of a scoring kiosk of FIG. 1.
Figure 11:
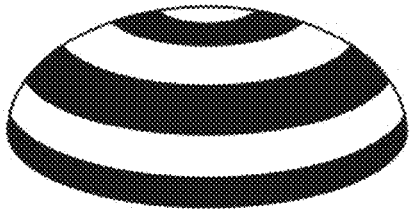
FIGS. 11-16 are views of a variety of print that may be used on targets.
Figure 12:
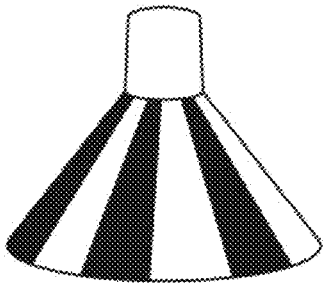
Figure 13:
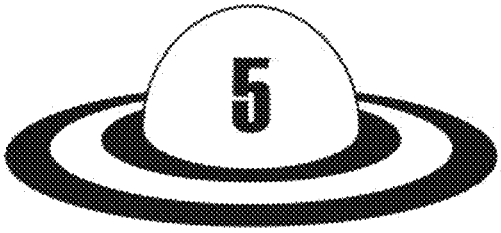
Figure 14:
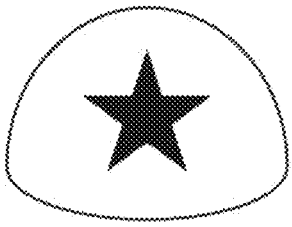
Figure 15:
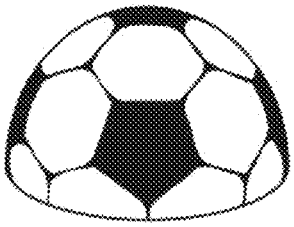
Figure 16:
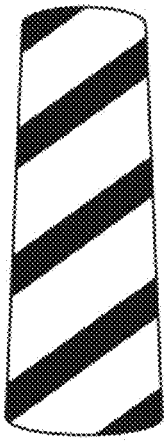

FIG. 10 is a plan view of one of the scoring kiosks 20, each of which includes a touch screen showing a display of the targets arranged in the same manner as they are arranged on the field. When a player launches a projectile that hits one of the targets, a score may be generated and displayed on the screen of the kiosk in a variety of ways. If there is a tracking system as described earlier, a user uses a user interface to input into the kiosk (or into a smart phone or other device) which player is getting ready to hit the golf ball or to launch another type of projectile, and then the tracking system tracks the projectile to sense whether the projectile hits a target and communicates with the controller to generate the score displayed on the screen of the kiosk 20. If an automated tracking system is not used, and a local sensor at the target is used to sense when the target is hit and to generate a response such as turning on lights and generating sounds, the scorekeeper can simply touch the respective target image on the screen of the kiosk 20 or generate some other input into the kiosk or smart phone or other device to generate a score that is shown on the screen of the kiosk 20 and/or displayed on the smart phone or other device.

FIGS. 11-16 show that the targets may have various images on them, such as circular stripes to create a bullseye, or a number to indicate the score for that target, or other images, as desired. The targets may have a variety of shapes, including the shapes of animals, cartoon characters, and other shapes, as desired.

Figure 17:
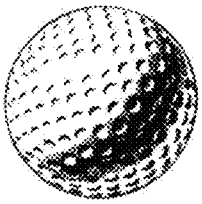
FIGS. 17-19 are views of a variety of projectiles that may be used to hit the targets of FIG. 1.
Figure 18:
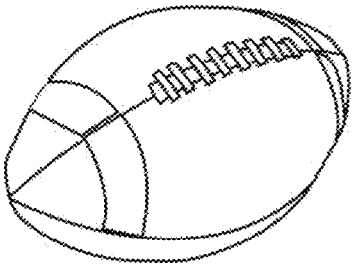
Figure 19:
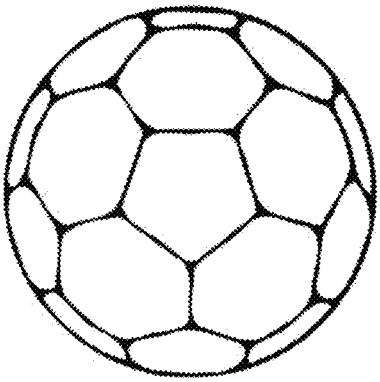

FIGS. 17-19 show various types of projectiles that may be used in the game to hit the targets. FIG. 17 shows a golf ball. FIG. 18 shows a football. FIG. 19 shows a soccer ball. These various projectiles may be made to glow in the dark, using known technology, so they can be seen in the dark. In that manner, the players and spectators can watch the projectiles travelling from the tee area 12 to the targets even in the dark. (If there is a visual tracking system to track the projectiles, that tracking system also may take advantage of the glowing projectile to be able to track the projectile in the dark.) The projectiles also may include paintballs, rubber bullets, soft-tipped arrows, and various other types of user-controlled projectiles that do not damage the targets.

FIG. 2 is a schematic of one type of control system that may be used for this system. In this arrangement, each target has a controller 36 that controls the lights at that respective target. The controller 36 communicates with other controllers 36 in the system in a daisy chain arrangement so all the controllers 36 can communicate with each other. The communication paths may be hard wired or wireless. The controllers 36 also communicate with the sensors 34, lights 32, and sound generators 22 through wired or wireless communication paths. A controller 36 may control the lights and sounds for more than one target or sound generator, so it is not necessary to have a controller at each target. The light sources 32 may alternatively be battery powered. FIG. 2 shows one of the sound generators 22 located in the tee area 12. It also shows other sound generators 22A dispersed around the field with the targets.

When a sensor 34 associated with a particular target senses that the skin of its target has been hit, that sensor 34 sends a signal to a controller 36, such as the controller 36 associated with the respective target, and that controller 36 is programmed to generate a response, which, for example, may be to flash the lights 32 inside that particular target or to change the color of some or all of the lights 32 for a brief period and then return to the original color. The controller 36 may cause the lights 32 of a target to cycle through various different colors when the target has been hit.

Since the controllers 36 communicate with each other, all the controllers 36 dispersed around the field as well as the central controller 36 in the tee area know which target has been hit and also may be programmed to generate a response. For example, the controllers 36 may cause the sound generators 22 to generate a different sound when each different target is hit or may generate one type of sound when one shape of target is hit and another type of sound when another shape of target is hit. The controller also may cause the lights 32 of nearby targets to light up or flash or change colors when a target is hit. For example, when the inflated pylon target 14A in the far back of the field of FIG. 1 is hit, the controller(s) 36 may cause the smaller mushroom targets 14B around the base of the inflated pylon 14A to light up or flash as well. As another example, if a target has a skirt target around it, such as the pylon 14A with the skirt target 14D, the skirt target 14D may also be made to flash or change colors when the pylon 14A is hit, or the pylon 14A may be made to flash or change colors when its skirt 14D has been hit.

If a tracking system as described above is used to track the projectiles, then the tracking system communicates with the controller(s) 36 to generate responses when the targets are hit, including turning lights on and off, generating sounds, and generating scores that may be displayed on screens or other displays.

Figure 20B:
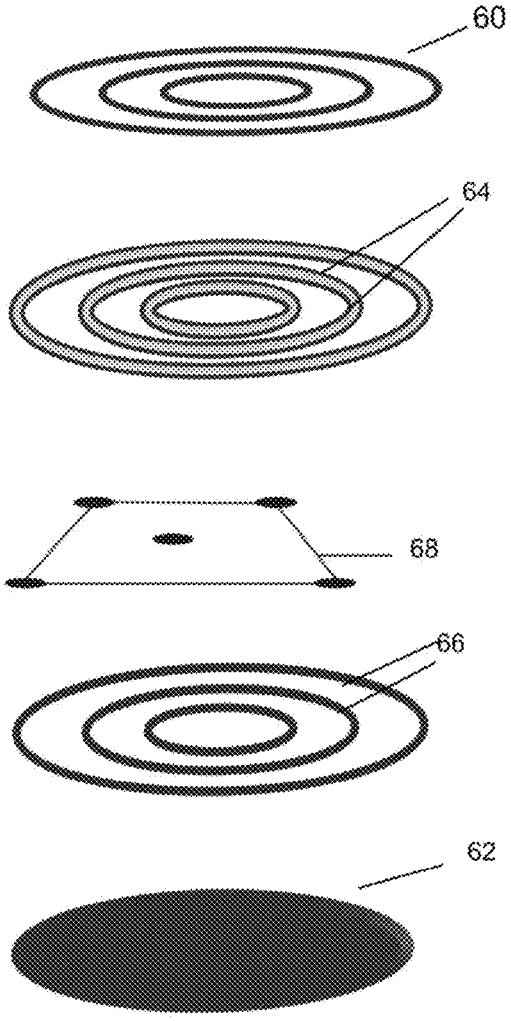
FIG. 20B is an exploded perspective view of the target of FIG. 20A.
Figure 20A:
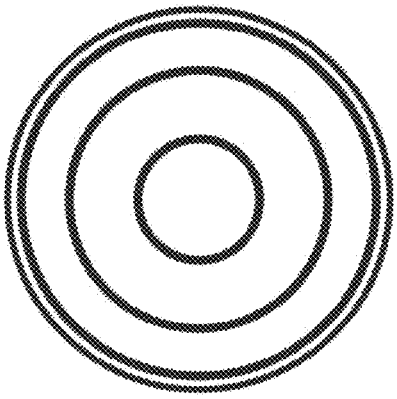
FIG. 20A is a top view of another target.

FIGS. 20A and 20B show another alternative type of target that may be used in the arrangement of FIG. 1. This type of target also may be used in the arrangement of FIG. 23, described later. This target has top and bottom skins 60, 62. The top skin 60 has some rings that permit more light to pass through and some rings that permit less light to pass through, so some of the rings glow more than others. Below the top skin 60 are ring-shaped, transparent bladders 64, which are inflated to space the top skin 60 a distance above the bottom skin 62. The bladders 64 serve as the framework that defines the shape of the top skin. Below the bladders 64 are LED light ropes 66, in rings having the same general dimensions as the bladders 64, so the LED lights in the light ropes shine upwardly through the bladders 64 and through the top skin 60. Below the bladders 64 also is one or more sensors 68, as described earlier with respect to other targets, which senses when the top skin 60 is hit by a projectile. Since the sensors 68 and lights 66 are below the bladders 64 and between the top and bottom skins 60, 62, the sensors and lights are well-protected from projectiles and from the weather. In this arrangement, the entire target may lie on top of the ground. Alternatively, a recess may be made in the ground, so everything except the top skin 60 lies within the recess, and the top skin 60 is flush with the ground. The top and bottom skins 60, 62 are secured to the ground around their perimeters. There also may be a pylon (as shown in FIGS. 3A and 3C) projecting upwardly from the center of this target or next to this target. This target functions in a similar manner to the targets described earlier. The pylon may include lights that project onto the target from outside the target's skin.

Figure 21B:
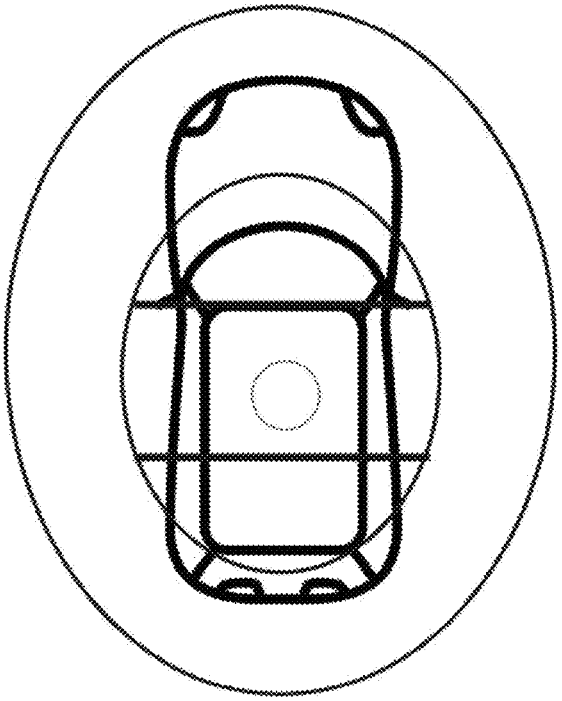
FIG. 21B is a top view of the target of FIG. 21A.
Figure 21A:
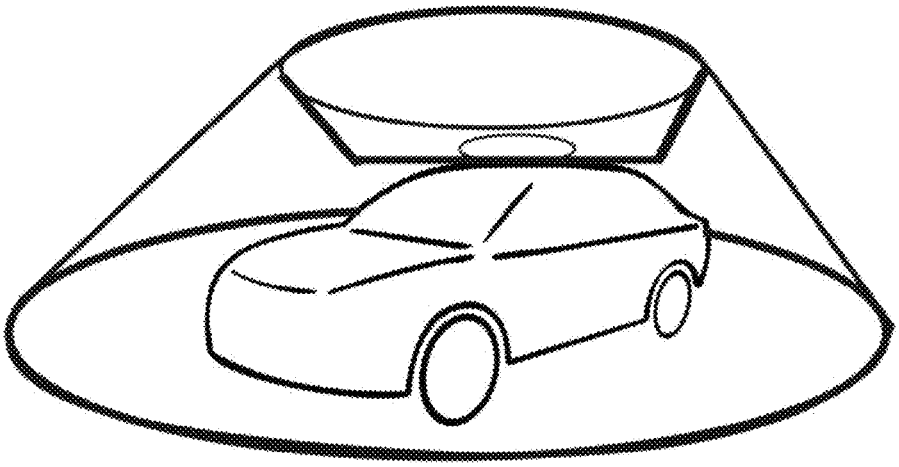
FIG. 21A is a front view of another target.

FIGS. 21A and 21B show a stationary target used to display something (in this case a car). The target has a relatively rigid framework, with a transparent skin supported on the framework. The framework secures to the top of the car. The framework also includes a bottom ring, which holds the bottom of the skin down on the ground (like a hoop skirt that touches the ground). A sensor and light inside the skin perform the same functions described earlier. This framework and skin protect the car from projectiles and from the weather.

Figure 22:
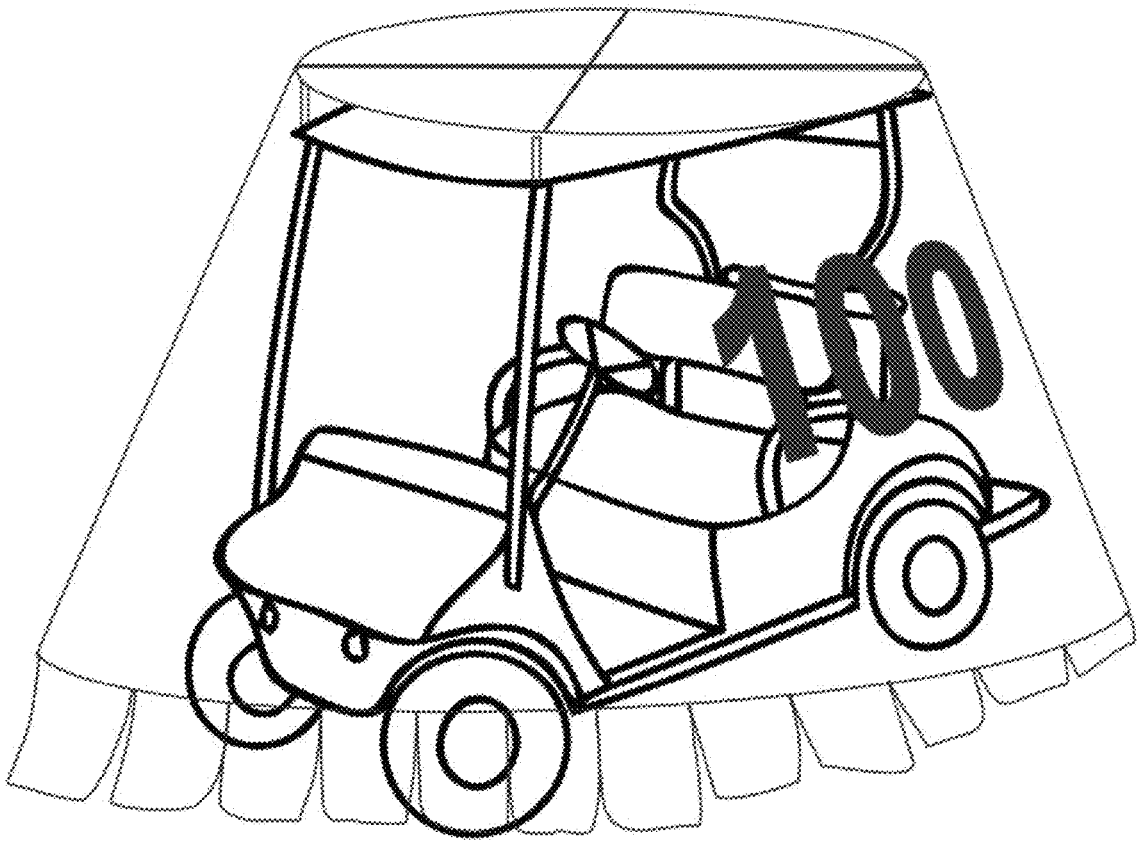
FIG. 22 is a front view of another target.

FIG. 22 show a movable target that is secured to a vehicle, which, in this case, is a golf cart. Again, there is a framework that mounts to the top of the vehicle, and the skin drapes over the framework. This embodiment includes a flexible skirt secured to the bottom of the skin, which allows the skirt to drag along the ground when the target is travelling, without harming the skin of the target. Again, there is a light inside the skin, and there is a sensor associated with this target.

Figure 23:
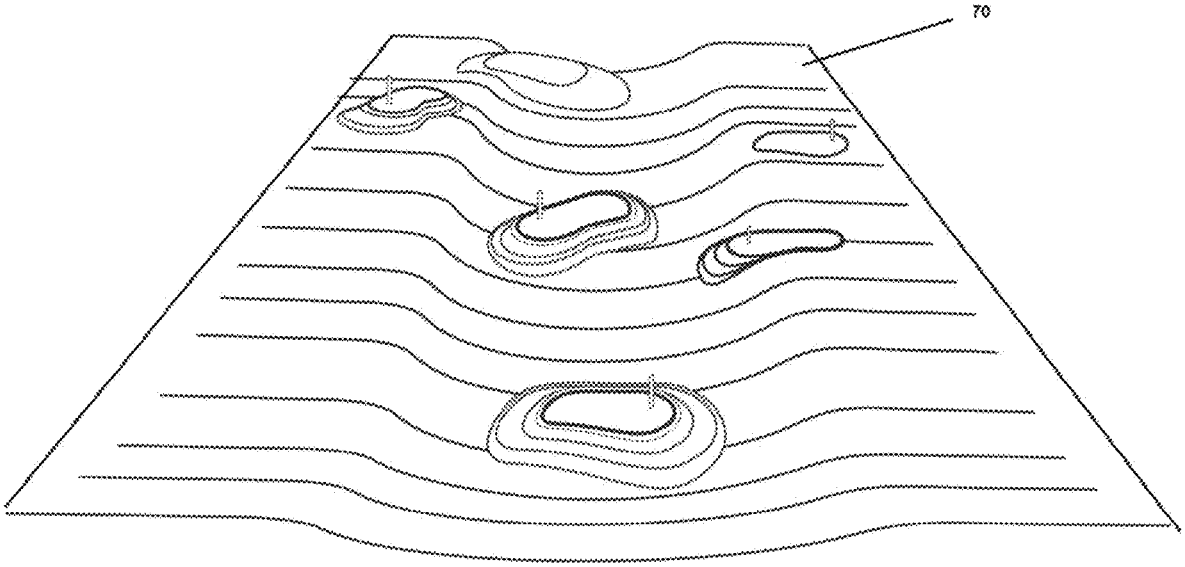
FIG. 23 is similar to FIG. 1, but showing an alternative embodiment.

In another alternative embodiment, as shown in FIG. 23, the portion of the arrangement between the targets (field area 70) is made of sheet vinyl or polyethylene or other plastic sheet instead of synthetic turf, and the ground underneath is graded so that balls automatically roll down to one or more basins or gathering areas, where they can be picked up, without requiring a person to go all around the field picking up balls. These basins also include drains, for draining away water that falls onto the plastic sheet. In this arrangement, the targets may be independent of the plastic sheet, or they may be adhered to or fused to the plastic sheet or otherwise secured to the plastic sheet. If the target shown in FIGS. 20A and 2B is used, and if everything except the top sheet 60 is recessed into the ground, the top sheet 60 may be fused to the plastic sheet 70. Vinyl field design can use multiple colors of material to simulate the look of golf. This ground cover is impermeable to water, so it sheds water to the basin points, which also serve as ball shagging points. This arrangement does not require extensive ground irrigation, as compared to water permeable synthetic turf.

While several types of targets and controlled responses have been described, there may be many different types of targets and many types of controlled responses.

The targets may have a variety of shapes in addition to those already shown and described herein, including complex shapes. It should be noted that these targets are quite large. For example, the mushroom targets usually are 15 to 60 feet in diameter and up to ten feet tall. Pyramid-shaped and cylindrically-shaped pylons usually are 10-20 feet in diameter and up to 30 feet tall. The skirts that wrap around the mushrooms and the pylons can be as large as 100 feet in diameter. In any case, the targets have at least one dimension that is at least three feet so the targets can be visible from a distance by the players.

The tie-down cables 40 may be anchored to the ground using spikes driven into the ground or using anchoring bolts, or any other desirable anchoring method.

The sound generator 16 may generate the sound of an explosion when one target is hit, the sound of a scream when another target is hit, and the sound of music when another target is hit, for example.

Glowing golf balls or other projectiles may have a 50% strontium aluminate skin to make them glow in the dark. When activated with a suitable dopant, such as europium or dysprosium, the strontium aluminate acts as a photoluminescent phosphor with a long persistence of phosphorescence. The photoluminescent pigment in the golf ball is activated with a UV light source in a ball dispenser at the hitting bay of a driving range. Other known ways of providing a glowing projectile could be used as well, such as an LED powered range ball.

In this embodiment of an open field game arrangement 10, the targets are hit by golf balls being driven from the end of the driving range. In other scenarios, the targets may be hit by other projectiles, such as a baseball or a football, or they may be hit by people running past them and hitting the targets with a paddle, for example. Because of their mobility, targets also can be placed on fairways or greens and hit from various locations.

This specification refers to lights shining on the targets and lights shining through the targets. It is understood that, since the targets are made of a thin skin through which light can pass, a light shining on the skin of the target also will shine through that skin. Of course, in order for a light to shine through the skin, it first shines on the skin. Also, it should be noted that turning on a light may include repeatedly turning the light on and off or flashing the light.

It will be obvious to those skilled in the art that various modifications may be made to the embodiments described above without departing from the scope of the present invention as claimed.

What is claimed is:

1. A target for an open field game arrangement, comprising:

skin, the skin comprising a transparent or translucent material and defining a hollow interior of the target;

a sensor arrangement, the sensor arrangement comprises at least one sensor configured to sense a mechanical force, a control arrangement, the control arrangement comprising at least one controller, a response arrangement, the response arrangement comprising at least one light source, the at least one light source located within the hollow interior and configured to shine outwardly through the skin of the target, wherein the at least one sensor, the at least one controller, and the at least one light source are configured to communicate with each other using a communication network, wherein the at least one sensor sends one or more sensor signals to the at least one controller when the at least one sensor detects the mechanical force, and wherein the at least one controller sends one or more response signals to at least one light source in response to receiving the one or more sensor signals, the one or more response signals controlling the at least one light source.

2. The target of claim 1, wherein the skin is made of a rigid material.

3. The target of claim 1, wherein the skin is made of a foldable material.

4. The target of claim 3, wherein the skin of foldable material holds it shape by being inflated.

5. The target of claim 3, wherein the skin of foldable material holds it shape by a support framework of flexible ribs.

6. The target of claim 5, wherein the flexible ribs comprises fiberglass ribs, metal ribs, or inflatable ribs.

7. The target of claim 1, wherein the mechanical force is a sound vibration or a physical impact.

8. The target of claim 1, wherein the at least one sensor is a microphone or piezo-electric sensor.

9. The target of claim 1, wherein the at least one source light comprises a plurality of light sources.

10. The target of claim 1, wherein the one or more response signals selectively and individually controls the at least one light source to turn on or off, flash, change to a different color, and/or cycle through one or more different colors.

11. The target of claim 1, wherein the response arrangement further comprising at least one light source located exteriorly to the target and configured to shine light onto an outer surface of the skin.

12. The target of claim 1, wherein the response arrangement further comprising at least one sound generator, the at least one sound generator being configured to communicate with the at least one controller, wherein the at least one controller sends one or more response signals to at least one sound generator in response to receiving the one or more sensor signals, the one or more response signals controlling the at least one sound generator to produce one or more types of sound.

13. The target of claim 1, wherein the at least one sensor and/or the at least one controller are housed within the hollow interior or located outside the target.

14. The target of claim 1, wherein the communication network is a wired communication network, a wireless communication network, or a combination thereof.

15. The target of claim 1, wherein the one or more sensor signals and the one or more response signals can be an analog signal, a digital signal, an electrical signal, an optical signal, or a hybrid electro-optic transmission.

16. The target of claim 1, wherein the at least one controller is configured to communicate with other controllers and sensors from other targets using the communication network, the communication network is a wired communication network, a wireless communication network, or a combination thereof.

17. The target of claim 1, wherein said controller is configured to communicate with one or more display screens using the communication network, the communication network is a wired communication network, a wireless communication network, or a combination thereof.

18. The target of claim 9, wherein said one or more display screens comprise a fixed screen or a portable device.

19. The target of claim 1, wherein the target is a stationary target or a movable target.

20. The target of claim 1, wherein the at least one sensor is implemented as a feature of a tracking system.

* * * * *